US005418103A

United States Patent [19]

Muto et al.

[11] Patent Number: 5,418,103

[45] Date of Patent: May 23, 1995

[54] TONER FOR DEVELOPING LATENT ELECTROSTATIC IMAGES

[75] Inventors: Kenkichi Muto; Hiroyuki Fushimi, both of Numazu; Akihiro Kotsugai, Shizuoka; Yoichiro Watanabe, Fuji, all of Japan; Ian Harpur, England, Great Britain

[73] Assignee: Ricoh Company, Ltd., Tokyo, Japan

[21] Appl. No.: 947,070

[22] Filed: Sep. 18, 1992

[30] Foreign Application Priority Data

Sep. 20, 1991 [JP] Japan ..... 3-241317

[51] Int. Cl.[6] ..... G03G 9/00

[52] U.S. Cl. ..... 430/109; 430/110; 430/137; 430/904

[58] Field of Search ..... 430/109, 110, 137, 904

[56] References Cited

U.S. PATENT DOCUMENTS

| | | | |
|---|---|---|---|
| 5,168,028 | 12/1992 | Nanya et al. | 430/110 |
| 5,206,109 | 4/1993 | Anno | 430/137 |
| 5,215,851 | 6/1993 | Tomita et al. | 430/137 |

*Primary Examiner*—S. Rosasco

*Attorney, Agent, or Firm*—Cooper & Dunham

[57] ABSTRACT

A toner prepared by allowing finely-divided particles of a vinyl resin having an alkali-reactive group to react with a fluorine-containing quaternary ammonium salt to obtain surface-modified finely-divided particles; mixing the surface-modified finely-divided particles and core particles composed of a resin and a coloring agent; and filming the above core particles with the finely-divided particles of the surface-modified vinyl resin with application of mechanical energy thereto.

11 Claims, No Drawings

TONER FOR DEVELOPING LATENT ELECTROSTATIC IMAGES

BACKGROUND OF THE INVENTION

1. Field of the Invention

The present invention relates to a toner for developing latent electrostatic images for use in a one-component or two-component type developer in the fields of electrophotography, electrostatic recording and electrostatic printing.

2. Discussion of Background

Latent electrostatic images formed on an electrophotographic photoconductor and an electrostatic recording medium are generally developed by a wet-type development method using a liquid developer, or a dry-type development method. The dry-type development method employs (i) a one-component type dry developer consisting of a toner comprising a coloring agent such as a dye or pigment and a binder resin in which the coloring agent is dispersed, or with addition of a charge controlling agent thereto when necessary, or (ii) a two-component type dry developer comprising the above-mentioned toner and solid carrier particles. These development methods have their own advantages and disadvantages, but the dry-type development method is more widely employed.

In order to obtain high quality toner image and to improve the durability of the toner, the aforementioned toner is required to have a small particle diameter, to be classified within a narrow particle size distribution, to have a smooth surface profile and to comprise a charge controlling agent which is uniformly dispersed therein. More specifically, the particle size of the toner has an effect on the resolution, sharpness and half tone reproduction performance of obtained toner images. When the particle size distribution of toner particles is wide, only the toner particles of a specific size are selectively supplied for development, thereby decreasing the durability of the toner. In addition, when the surface of the toner particle is not smooth, the surface portion of the particle cracks under the application of stress thereto in the course of stirring in a development unit, thereby generating minute toner powder. As a result, in the case where the toner is used in a two-component type developer, the aforementioned toner powder is melt with application of heat thereto and adheres to the surface of a carrier particle, which impairs the chargeability of developer. In the one-component type developer, the fused toner powder adheres to the surface of a toner-thin-film regulating member in the development unit, which causes white lines to appear on the obtained solid images. Furthermore, when the charge controlling agent is not uniformly dispersed in the toner formulation, the toner deposition on the background is caused.

Conventionally, the toner is prepared by kneading a resin component, a coloring agent component such as a dye or pigment and a charge controlling agent under application of heat thereto, cooling the kneaded mixture, crushing the same by a mechanical or air-impaction crusher, and classifying the crushed particles. However, especially when the toner particles with a small size and a narrow particle size distribution are desired, the production efficiency and the yield are considerably decreased, and consequently the cost is increased. In addition, the smaller the particle size of toner, the poorer the dispersion uniformity of charge controlling agent therein. This causes the failure of toner charging characteristics. Further, when the toner particles are prepared by the above-mentioned preparation method, many protruding portions are formed on the surface of the toner particle after crushing. Therefore, those toner particles easily adhere to the carrier or the toner-thin-film regulating member under application of heat to the toner particles. Moreover, the charge controlling agent, which is relatively expensive, exhibits its function when staying on the surface of the toner particle. By the conventional preparation method, part of the charge controlling agent is contained in the toner particle. This increases the manufacturing cost of the toner.

To obtain a toner with high durability, capable of producing high quality toner images, many proposals are made. For instance, it is proposed in Japanese Patent Publications 51-14895 and 47-51830 that a core particle of a toner which comprises a pigment and a charge controlling agent be prepared by suspension polymerization. In the above method, however, agents employed, such as a dispersion stabilizing agent and a surface active agent are attached to the surface of the obtained toner particle and it is difficult to eliminate them therefrom. As a result, the charging characteristics of the toner particles tend to deteriorate because of those agents remaining on the surface of the toner particles. In addition, when the core particle of toner is prepared by polymerization, it is also difficult to stably produce toner particles all having small diameter and being classified within a narrow particle size distribution.

In Japanese Patent Publications 57-494 and 56-13945, it is proposed that a toner particle containing a core therein which comprises a pigment and a charge controlling agent be prepared by spraying. However, this method has the shortcomings that the classification is necessitated after preparation of toner particles because control of the particle diameter is difficult, and that a polymeric resin which can effectively prevent the hot off-set phenomenon cannot be used.

To eliminate the above-mentioned shortcomings, it is proposed that a coloring agent be fixed to a resin particle by the application of mechanical energy thereto in Japanese Laid-Open Patent Applications 63-23166 and 63-2075. In the toner thus prepared, however, the coloring agent hinders the fixing performance of the toner.

For obtaining a toner with improved charging controllability, it is proposed to fix the charge controlling agent into a toner particle or a resin particle containing a coloring agent as disclosed in Japanese Laid-Open Patent Applications 63-289558, 62-209541, 63-27853, 63-27854, 63-244056 and 63-138358. However, when the charge controlling agent is fixed into the resin particle containing the coloring agent in such an amount that a sufficient charge quantity is imparted to the obtained toner particle, it is impossible to fuse the surfaces of the toner particles at a normal image fixing temperature because the charge controlling agent existing on the surfaces of toner particles have generally a high melting point. Consequently, a toner image fixing performance becomes poor.

Furthermore, the particle diameter of a charge controlling agent is required to be 1/10 or less that of the resin particle containing the coloring agent in order to uniformly attach the charge controlling agent to the surface of the resin particle containing the coloring agent. It is extremely difficult to produce such finely-divided particles of a charge controlling agent. Therefore, the charging characteristics on the surface of the toner particle becomes uneven, which results in a decrease of image quality.

To solve the above-mentioned problem, the inventors of the present invention proposed a toner prepared by fixing finely-divided particles of a mixture of a thermoplastic resin and a charge controlling agent into a resin particle containing a coloring agent. The toner thus prepared can meet both the requirements for the charging characteristics and the image fixing performance.

However, the aforementioned preparation method necessitates two materials of the finely-divided particles of a thermoplastic resin having charge controllability and a charge controlling agent, or requires two steps of forming a film of the finely-divided particles of a thermoplastic resin having charge controllability on the resin particle containing a coloring agent and embedding the charge controlling agent in the above-prepared film. In addition, this method has the shortcoming that it is difficult to use the charge controlling agent in the form of finely-divided particles. As stated above, not only the preparation procedure is complicated, but also a sufficient charge quantity cannot be imparted to the toner particle uniformly.

In Japanese Laid-Open Patent Applications 63-301964 and 63-305366, a charge controlling agent and finely-divided inorganic particles or finely-divided resin particles are mixed by the wet process and the mixture is dried so as to attach the charge controlling agent to the surface of the finely-divided inorganic or resin particles. The finely-divided particles thus prepared are fixed on a resin core particle. According to this method, uniform charging characteristics can be obtained because the charge controlling agent is attached to the finely-divided inorganic or resin particles, and available in the form of finely-divided particles. However, since the charge controlling agent merely attaches to the surface of the finely-divided inorganic or resin particles, the durability of the charge controlling agent cannot be improved.

SUMMARY OF THE INVENTION

Accordingly, a first object of the present invention is to provide a toner, free from the above-mentioned conventional shortcomings, which has uniform charging characteristics and improved durability, and is capable of developing latent electrostatic images into clear toner images and exhibiting satisfactory image fixing performance.

A second object of the invention is to provide a method of producing the above-mentioned toner.

The first object of the present invention can be achieved by a toner prepared by the process comprising the steps of allowing finely-divided particles of a vinyl resin having an alkali-reactive group to react with a fluorine-containing quaternary ammonium salt to obtain surface-modified finely-divided particles; mixing the surface-modified finely-divided particles and core particles comprising a resin and a coloring agent; and filming the core particles with the above obtained finely-divided particles of the surface-modified vinyl resin with application of mechanical energy thereto.

The second object of the present invention can be achieved by a process of preparing a toner comprising the steps of allowing finely-divided particles of a vinyl resin having an alkali-reactive group to react with a fluorine-containing quaternary ammonium salt to obtain surface-modified finely-divided particles; mixing the surface-modified finely-divided particles and core particles comprising a resin and a coloring agent; and filming the core particles with the above obtained finely-divided particles of the surface-modified vinyl resin with application of mechanical energy thereto.

DETAILED DESCRIPTION OF THE PREFERRED EMBODIMENTS

The core particle of a toner according to the present invention comprises a conventionally known resin and coloring agent. This kind of core particle may be prepared by kneading a mixture of the resin and the coloring agent and crushing the mixture. Alternatively, the core particle may be prepared by suspension polymerization of a vinyl monomer containing a coloring agent. Or a resin particle prepared by emulsion polymerization method may be mixed with a coloring agent to prepare a core particle. In particular, it is preferable to dye a resin particle obtained by dispersion polymerization method with a dye to prepare a core particle in the present invention. This is because the resin particles prepared by dispersion polymerization are almost in a complete spherical shape and they are classified in a narrow particle size distribution. Even after those resin particles are subjected to a dying treatment and a filming treatment by use of a charge controlling agent, the narrow particle size distribution can be maintained. Consequently, toner particles with a narrow particle size distribution can be prepared in the final stage. In the toner particles of the present invention, the ratio of the volume mean diameter to the number mean diameter is preferably 1.3 or less from the viewpoints of high resolution of obtained toner images and the uniform charge quantity of toner particles.

To dye the resin particles prepared by dispersion polymerization with a dye, the dye is dissolved in an organic solvent in which the resin particles are insoluble, and the resin particles are dispersed in the above dye solution with stirring under application of heat thereto when necessary. After the dyed resin particles in a wet state are separated from the dispersion, they are subjected to a filming treatment by using surface-modified finely-divided particles prepared by allowing finely-divided particles of a vinyl resin having an alkali-reactive group to react with a fluorine-containing quaternary ammonium salt. Alternatively, the dyed resin particles may be dried before filming treatment.

The aforementioned finely-divided particles of a vinyl resin having an alkali-reactive group and a fluorine-containing quaternary ammonium salt, which undergo the reaction to obtain the surface-modified finely-divided particles, will now be explained in detail.

To bond an alkali-reactive group to a vinyl resin particle, the vinyl resin is prepared by polymerization in the presence of a polymerization initiator having an alkali-reactive group; or prepared by copolymerization using a vinyl monomer having an alkali-reactive group. The above two methods may be used in combination.

It is preferable to prepare the aforementioned vinyl resin particles by soap-free emulsion polymerization. This is because when the polymerization is carried out in the presence of an emulsifier, it becomes remarkably difficult to remove the emulsifier from the obtained resin particles. When the resin particles containing the emulsifier are included in the toner particles, the weather resistance of toner is decreased. In particular, an anionic emulsifier is not preferable because it is allowed to react with a quaternary ammonium salt to form a complex, which causes the durability of toner to deteriorate.

Namely, a polymerizable vinyl monomer is added to an aqueous medium without using any emulsifier or with the addition of a slight amount of the emulsifier. After the atmosphere is replaced with an inert gas such as nitrogen, a water-soluble polymerization initiator having an alkali-reactive group is added to the aqueous medium, and then the polymerization is carried out in a stream of nitrogen with stirring under application of heat. Thus, the particles of the vinyl resin having an alkali-reactive group can be obtained.

Examples of the polymerizable vinyl monomer for preparing the vinyl resin include styrene and styrene derivatives such as α-methylstyrene, vinyltoluene and parachlorostyrene; (meth)acrylic acid alkyl esters such as methyl (meth)acrylate, ethyl (meth)acrylate, n-butyl (meth)acrylate and 2-ethylhexyl (meth)acrylate; vinyl esters such as vinyl acetate and vinyl propionate; vinyl ethers such as methyl vinyl ether and ethyl vinyl ether; vinyl nitriles such as acrylonitrile and methacrylonitrile; dienes such as butadiene and isoprene; and halogenated vinyl such as vinyl chloride and vinylidene chloride. Of the above, styrenes, acrylic acid esters and methacrylic acid esters are preferably used. The aforementioned polymerizable vinyl monomer may be copolymerized with an acrylic acid, methacrylic acid, styrenesulfonic acid, acrylic acid-2-sulfoethyl, methacrylic acid-2-sulfoethyl, and alkali metal salts and ammonium salts thereof. Those monomers can be efficiently allowed to react with a fluorine-containing quaternary ammonium salt.

A chain transfer agent may be added to the above polymerizable vinyl monomer for the purpose of adjusting the molecular weight. As the chain transfer agent, for instance, n-dodecyl mercaptan, t-dodecyl mercaptan, 1-octyl mercaptan or t-octyl mercaptan is usable.

The preferable glass transition temperature of the obtained vinyl resin having an alkali-reactive group is 50° C. or more from the viewpoint of heat-resistant preservability of the obtained toner. When the above vinyl resin has the glass transition temperature of 50° C. or more, the blocking phenomenon does not occur during the storage of the toner.

It is preferable that the softening point of the aforementioned vinyl resin measured by a flow tester of capillary type be in the range of 60° to 130° C. When the softening point is within the above range, there is no problem in the toner image fixing performance.

It is preferable that the number mean diameter of the above-mentioned vinyl resin particle be 1/10 or less that of the core particle comprising the resin and the coloring agent. When the number mean diameter of the vinyl resin particle is designed as previously mentioned, the reaction product of finely-divided particles of the vinyl resin and the quaternary ammonium salt (hereinafter referred to as surface-modified finely-divided particles) can be uniformly attached to the surface of the core particle, so that the uniform chargeability can be imparted to the toner.

As the water-soluble polymerization initiator used in preparation of the vinyl resin particles, a persulfate such as ammonium persulfate, sodium persulfate and potassium persulfate; and an azo compound such as 4,4'-azobis-4-cyanovalerianic acid are employed. In addition to the above, a redox-type polymerization initiator composed of a persulfate and a thiosulfate may be employed. Furthermore, the above-mentioned polymerization initiators having an alkali-reactive group may be used in combination with a water-soluble peroxide such as hydrogen peroxide, succinic acid peroxide, t-butyl hydroperoxide or t-butyl peroxymaleic acid.

It is preferable that the amount of the polymerization initiator be 0.1 to 1 wt. % of the total weight of the polymerizable vinyl monomer. Within the above range, the rate of polymerization (conversion) is sufficient and the weather resistance of the obtained toner does not deteriorate.

As the aqueous medium used in polymerization of the vinyl monomer, ion exchange water is used alone, or with the addition thereto of a solvent which is water-soluble, but does not dissolve the produced vinyl resin particles therein, such as methanol or ethanol.

The total amount of the aforementioned aqueous medium and polymerizable vinyl monomer may be placed in a reaction vessel at the beginning of polymerization, or they may be added dropwise to carry out the polymerization reaction. The polymerization initiator may also be used likewise.

The above-mentioned predetermined materials are put in a polymerization vessel, and the atmosphere is replaced by nitrogen with the application of heat thereto, so that the polymerization of vinyl monomer is initiated in a stream of nitrogen.

The preferable polymerization temperature is within the range from 40° to 90° C. The polymerization is completed in 10 to 30 hours. As the preferable polymerization method in the present invention, a hydrophilic polymerizable vinyl monomer is first polymerized using the water-soluble polymerization initiator having an alkali-reactive group in the presence of a slight amount of a fluorine-containing surface active agent to form a seed particle, and a hydrophobic polymerizable vinyl monomer is further polymerized to obtain a hydrophobic resin particle. When a decomposition product of the undecomposed polymerization initiator or a water-soluble oligomer exists in the polymerization system after polymerization, the quaternary ammonium salt thereafter added to the polymerized vinyl resin particles is oxidized by such a material, thereby causing the charging characteristics of the obtained toner to deteriorate. Therefore, it is necessary to heat the polymerization system until the polymerization initiator is completely decomposed.

Furthermore, an anion and a water-soluble oligomer produced in the process of polymerization reaction, and an anion of the redox-type polymerization initiator also react with the quaternary ammonium salt to form a salt. The salt thus formed is responsible for a decrease in chargeability of toner while the toner is stirred over a period of long time. Therefore, it is preferable to remove the above-mentioned anion and water-soluble oligomer from an emulsion of the vinyl resin particles by use of a dialysis membrane, an ion exchange resin, an ion-exchange membrane or a separation filter, or by means of centrifugal sedimentation. Such a removal operation may be carried out after the vinyl resin particles are allowed to react with the fluorine-containing quaternary ammonium salt.

In the present invention, the conventional fluorine-containing quaternary ammonium salts having a negative charge controllability are allowed to react with the above-prepared finely-divided particles of the vinyl resin to obtain the surface-modified finely-divided particles.

The following examples of the fluorine-containing quaternary ammonium salts having a negative charge controllability are preferable:

$R_fN^+(R^1)_3X^-$,

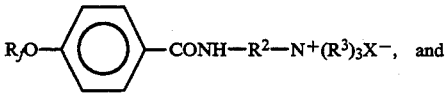

and

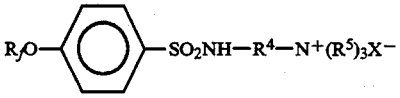

wherein $R_f$ represents a fluorine-containing group having 6 to 9 carbon atoms, preferably a straight-chain or branched-chain perfluoroalkyl group or perfluoroalkenyl group; $R^1$, $R^2$, $R^3$, $R^4$ and $R^5$ each represent a lower alkyl group having 1 to 4 carbon atoms, and $R^2$ and $R^3$, or $R^4$ and $R^5$ may be the same or different; and X represents a halogen.

The above fluorine-containing quaternary ammonium salt is added to the emulsion of vinyl resin particles and a mixture is stirred at 10° to 60° C. for 10 minutes to 5 hours. When the quaternary ammonium salt is added to the emulsion, the ammonium salt in a solid state or dissolved in water or a water-soluble solvent is available.

It is preferable that the ratio of the vinyl resin particles to the quaternary ammonium salt by weight be within the range from (100:0.5) to (100:5), and more preferably (100:1) to (100:4). Within the above range, the ratio of the vinyl resin particles to the quaternary ammonium salt may be finely adjusted so as to impart the optimal charge quantity to the obtained toner.

The emulsion containing the reaction product of the vinyl resin particles and the fluorine-containing quaternary ammonium salt can be used as it is, or if necessary, it may be subjected to filtration or centrifugal sedimentation to separate a water layer therefrom and remove the free salt or water-soluble oligomer which does not bond to the vinyl resin particles.

To film the previously mentioned core particle comprising the resin and the coloring agent with the above-prepared surface-modified finely-divided particles, the emulsion containing the surface-modified finely-divided particles are mixed with the core particles comprising the resin and the coloring agent by a wet process and the mixture thus obtained is dried followed by the filming operation. Alternatively, after the emulsion containing the surface-modified finely-divided particles are dried, the surface-modified finely-divided particles and the core particles may be mixed by a dry process and the filming operation may be carried out.

The ratio of the surface-modified finely-divided particles to the core particles may be determined within the range of (1:100) to (20:100) parts by weight, with the optimal charge quantity of the obtained toner taken into consideration.

In the filming operation, mechanical energy is applied to the core particles to which the above-mentioned surface-modified finely-divided particles are attached in order to fix the surface-modified particles on the surfaces of the core particles. In addition to the mechanical energy, thermal energy may auxiliarily be applied when the surface-modified finely-divided particles are fixed on the surfaces of the core particles.

To apply the mechanical energy, there is known a method of applying impact to the mixture by a blade which is rotated at a high speed; or a method of releasing both the surface-modified finely-divided particles and the core particles into a space of high-speed air stream and causing them to come into collision with each other, or with an adequate plate.

The core particle is thus filmed over with the surface-modified finely-divided particles, so that the toner particle of the present invention is obtained. The thus obtained toner particles may be mixed with a fluidity promoting agent such as a metallic oxides, for example, hydrophobic silica or alumina, in a mixer such as a V-blender or Henschel mixer.

The preparation of the core particles, the surface-modified finely-divided particles and the toner of the present invention will now be explained specifically.

Preparation of core particles (1) by dispersion polymerization 100 parts by weight of methanol is placed into a flask equipped with a stirrer, a nitrogen-introduction tube, a reflux condenser and a thermometer. After 5 parts by weight of methyl vinyl ether—maleic anhydride copolymer "Gantrade RN119" (Trademark), commercially available from Mitsubishi Corporation, is dissolved in the above prepared methanol, 32.5 parts by weight of styrene, 6 parts by weight of 2-ethylhexyl acrylate, 1.5 parts by weight of n-butyl methacrylate, 0.3 parts by weight of n-dodecyl mercaptan and 1.5 parts by weight of divinylbenzene are added to the above solution.

The thus prepared reaction mixture is heated to 65° C. with stirring at 100 rpm while the atmosphere is replaced with nitrogen. With the addition of 25 parts by weight of methanol in which 1.5 parts by weight of 2,2'-azobisisobutyronitrile is dissolved, the reaction mixture is heated for 20 hours. Thereafter, 2 parts by weight of "Oil Black 860" (Trademark), made by Orient Chemical Industries, Ltd., is added to the above reaction mixture, and then the mixture is stirred at 40° C. for one hour, whereby the resin particles are dyed.

The dispersion containing the dyed resin particles is filtered, and the residue thus obtained is stirred with the addition of methanol thereto, and filtered. The residue is dried in vacuo at 40° C., so that the dyed resin particles serving as core particles for toner particles are obtained. The volume mean diameter of the dyed resin particles is 7.5 μm, and the number mean diameter thereof is 7.3 μm, so that the ratio of the volume mean diameter to the number mean diameter is 1.12. Those particle diameters can be measured by a commercially available Coulter multisizer (made by Coulter Electronics Co., Ltd.) with an aperture of 100 μm.

Preparation of core particles (2) by suspension polymerization 15 parts by weight of carbon black "Raben 410" (Trademark), made by Columbia Carbon Ltd., and 0.25 parts by weight of 2,2'-azobisisobutyronitrile are added to 30 parts by weight of styrene. After the atmosphere is replaced with nitrogen, the above prepared reaction mixture is heated at 80° C. for 6 hours. The mixture is cooled, and then 92 parts by weight of styrene and 53 parts by weight of n-butyl methacrylate are added to the mixture and uniformly dissolved therein. The thus obtained carbon black dispersion is further dispersed in a ball mill for 20 hours. To 40 parts by weight of the above dispersion, 1 part by weight of 2,2'-azobis(2,4-dimethylvaleronitrile) is added and dissolved therein, so that an oil layer is prepared.

3.3 parts by weight of partially saponified polyvinyl alcohol "Poval 217E" (Trademark), made by Kuraray Co., Ltd., is dissolved in 150 parts by weight of ion-exchange water. To this solution, the above obtained oil layer is added and the mixture is dispersed in a commercially available homomixer "T.K. Homo Mixer" (Trademark), made by Tokushu Kika Kogyo Co., Ltd., at 6000 rpm for 10 minutes. With the addition of 0.1 g of water-soluble nigrosine, the above prepared dispersion is placed in an apparatus for polymerization, and with the atmosphere replaced with nitrogen, the polymerization is carried out at 60° C. for 8 hours. After the completion of polymerization, the reaction mixture is filtered with suction to separate the polymerized particles out of the reaction mixture. After washing with water followed by repeated filtration, the polymerized particles are dried in vacuo at 40° C., so that the dyed resin particles serving as core particles for toner particles are obtained. The volume mean diameter of the dyed resin particles is 7.8 μm, and the number mean diameter thereof is 6.1 μm, so that the ratio of the volume mean diameter to the number mean diameter is 1.28. Those particle diameters can be measured in the same manner as in the above.

Preparation of vinyl resin particles by soap-free emulsion polymerization 95 parts by weight of ion-exchange water is placed into a flask equipped with a stirrer, a dropping funnel, a nitrogen-introduction tube, a reflux condenser and a thermometer. After the atmosphere is replaced by nitrogen with the application of heat to the ion-exchange water, it is stirred at 200 rpm with the temperature thereof maintained at 65° C. A mixture of 21 parts by weight of styrene and 9 parts by weight of n-butyl acrylate is added dropwise to the above ion-exchange water over a period of 4 hours. Thereafter, 5 parts by weight of ion-exchange water in which 0.14 parts by weight of potassium persulfate is dissolved is added dropwise to the above reaction mixture over a period of 6 hours. After the reaction mixture is heated for 11 hours, it is further heated at 80° C. for 3 hours to complete the polymerization. Thus, vinyl resin particles are prepared.

The conversion of the above prepared vinyl resin particles is 97% and the number mean diameter thereof is 0.35 μm when measured by using "DLS-700" (Trademark), made by Otsuka Denshi Co., Ltd. The glass transition temperature of the vinyl resin particle in a dry state is 62° C. when measured by a commercially available differential scanning calorimeter "DPS-6151" (Trademark), made by Rigaku Corporation, with the temperature increased by 10° C./min. Using a flow tester of capillary type, commercially available from Shimadzu Corporation, the softening point and the flow-initiating point are measured in such a manner that 2.0 g of the obtained resin is put into a die having a 0.5 mm-diameter opening and a cylinder pressure of 10 kg/cm$^2$ is applied to the resin, with the temperature being increased by 3° C./min. As a result, the softening point and the flow-initiating point of the above resin particles are 74° C. and 160° C., respectively.

The emulsion containing those resin particles are subjected to centrifugal sedimentation to remove the free inorganic salt and water-soluble oligomer therefrom.

Preparation of surface-modified finely-divided particles

While stirring the emulsion containing such vinyl resin particles as prepared in the above, a methanol solution of the previously mentioned fluorine-containing quaternary ammonium salt is added to the above emulsion in such a way that the mixing ratio by weight of the vinyl resin particles to the quaternary ammonium salt is 100:3. Then, the mixture is stirred at 50° C. for 2 hours to complete the reaction.

After the completion of reaction, the emulsion is frozen by using dry ice methanol as a refrigerant, and a water component is distilled away under reduced pressure, so that the surface-modified vinyl resin is obtained in the form of dry particles.

Preparation of toner particles (1)

100 parts by weight of the core particles and 5 parts by weight of the surface-modified finely-divided particles are uniformly mixed by using "O.M. dizer" (Trademark), made by Nara Machinery Co., Ltd.

The thus obtained mixture is rotated at 10000 rpm for 5 minutes in a commercially available apparatus "Hybridization System NHS-O type" (Trademark), made by Nora Machinery Co., Ltd., for the purpose of applying mechanical energy to the mixture to firmly film the core particles with the surface-modified finely-divided particles. Thus, toner particles according to the present invention are obtained.

Preparation of toner particles (2)

100 parts by weight of the core particles in the form of a wet cake is dispersed in 5 parts by weight of an emulsion containing the surface-modified finely-divided particles. The thus obtained dispersion is dried by a spray dryer, so that a mixture is obtained in the form of powder.

The thus obtained mixture is rotated at 10000 rpm for 5 minutes in a commercially available apparatus "Hybridization System NHS-O type" (Trademark), made by Nara Machinery Co., Ltd., for the purpose of applying mechanical energy to the mixture to firmly film the core particles with the surface-modified finely-divided particles. Thus, toner particles according to the present invention are obtained.

Preparation of toner particles (3)

100 parts by weight of the core particles in the form of a wet cake is dispersed in water. While stirring the above prepared dispersion, 5 parts by weight of an emulsion containing the surface-modified finely-divided particles is gradually added to the dispersion. The mixture is allowed to stand for a while and the resultant supernatant is removed therefrom. The residue is filtered and the product thus obtained is dried and crushed, so that a mixture is obtained in the form of powder.

The thus obtained mixture is subjected to the filming operation in the same manner as in the above, so that the core particles are firmly filmed with the surface-modified finely-divided particles. Thus, toner particles according to the present invention are obtained.

According to the observation by a scanning-type electron microscope in the course of preparation of toner particles (1), (2) and (3), the surface-modified finely-divided particles are uniformly attached to the surface of the core particle before the filming operation. After the completion of the filming operation, the obtained toner particles are spheres having slight convex and concave portions.

Other features of this invention will become apparent in the course of the following description of exemplary embodiments, which are given for illustration of the invention and are not intended to be limiting thereof.

EXAMPLES 1 TO 10

Toner particles of the present invention were respectively prepared in Examples 1 to 10 using the respective materials under the conditions shown in Tables 1, 2 and 3.

TABLE 1

| | Constituting Monomers of Vinyl Resin Particles | | | | | |
|---|---|---|---|---|---|---|
| | St | nBA | nBMA | NaSS | DMC | (Note:1) |
| Example 1 | 24 | 6 | | | | |
| Example 2 | 24 | 6 | | | | |
| Example 3 | 21 | | 9 | | 0.3 | |
| Example 4 | 24 | 6 | | | | |
| Example 5 | 24 | 6 | | 0.15 | | |
| Example 6 | 24 | 6 | | | | (Note:2) |
| Example 7 | 24 | 6 | | | | (Note:3) |
| Example 8 | 27 | 3 | | | 0.3 | |
| Example 9 | 30 | | | | | |
| Example 10 | 24 | 6 | | | | |

(Note:1)
St - styrene
nBA - n-butyl acrylate
nBMA - n-butyl methacrylate
NaSS - sodium styrenesulfonate
DMC - dodecyl mercaptan
(Note:2) After completion of the polymerization, the water-soluble components were not removed by the centrifugal sedimentation.
(Note:3) The polymerization was carried out at 65° C. for 12 hours and the water-soluble components were not removed by the centrifugal sedimentation after polymerization.

TABLE 2

| | Reaction Product of Vinyl Resin Particles (i) and Fluorine-containing Quaternary Ammonium Salt (ii) | | | | |
|---|---|---|---|---|---|
| | Compound No. of (ii) (Note:1) | Mixing ratio of (i) to (ii) | Stirring Conditions | | |
| | | | Addition of (ii) | Temp. (°C.) | Time (hour) |
| Ex. 1 | No. 1 | 100/3 | adding of methanol solution containing Compound No. 1 | 50 | 2 |
| Ex. 2 | No. 1 | 100/3 | adding of Compound No. 1 in the form of powder | 50 | 2 |
| Ex. 3 | No. 2 | 100/3 | adding of methanol solution containing Compound No. 2 | 50 | 2 |
| Ex. 4 | No. 3 | 100/3 | adding of methanol solution containing Compound No. 3 | 50 | 2 |
| Ex. 5 | No. 1 | 100/5 | adding of methanol solution containing Compound No. 1 | 50 | 2 |
| Ex. 6 | No. 1 | 100/3 | adding of methanol solution containing Compound No. 1 | 50 | 2 |
| Ex. 7 | No. 1 | 100/3 | adding of methanol solution containing Compound No. 1 | 50 | 2 |
| Ex. 8 | No. 1 | 100/3 | adding of methanol solution containing Compound No. 1 | 50 | 2 |
| Ex. 9 | No. 1 | 100/3 | adding of methanol solution containing Compound No. 1 | 50 | 2 |
| Ex. 10 | No. 1 | 100/3 | adding of methanol solution containing Compound No. 1 | 50 | 2 |

TABLE 2-continued

| | Reaction Product of Vinyl Resin Particles (i) and Fluorine-containing Quaternary Ammonium Salt (ii) | | | | |
|---|---|---|---|---|---|
| | Compound No. of (ii) (Note:1) | Mixing ratio of (i) to (ii) | Stirring Conditions | | |
| | | | Addition of (ii) | Temp. (°C.) | Time (hour) |

Compound No. 1

(Note:1) Fluorine-containing quaternary ammonium salts

Compound No. 1 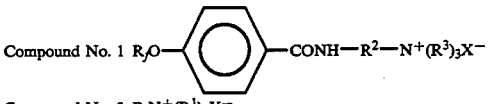

Compound No. 2 $R_fN^+(R^1)_3X^-$

Compound No. 3 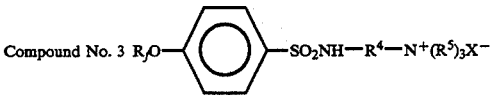

In the above, $R_f$ represents a fluorine-containing group having 6 to 9 carbon atoms, preferably a straight-chain or branched-chain perfluoroalkyl group or perfluoroalkenyl group; $R^1$, $R^2$, $R^3$, $R^4$ and $R^5$ each represent a lower alkyl group having 1 to 4 carbon atoms, and $R^2$ and $R^3$, or $R^4$ and $R^5$ may be the same or different; and X represents a halogen.

TABLE 3

| | Toner Particle | | |
|---|---|---|---|
| | Core Particle | Mixing Ratio of Core Particles to Surface-modified Resin Particles by Weight | Preparation Conditions |
| Ex. 1 | Preparation of core particles (1) | 100/5 | Preparation of Toner Particles (1) |
| Ex. 2 | same as above | 100/5 | same as above |
| Ex. 3 | same as above | 100/5 | same as above |
| Ex. 4 | same as above | 100/5 | same as above |
| Ex. 5 | same as above | 100/5 | same as above |
| Ex. 6 | same as above | 100/5 | same as above |
| Ex. 7 | same as above | 100/5 | same as above |
| Ex. 8 | same as above | 100/5 | same as above |
| Ex. 9 | same as above | 100/5 | same as above |
| Ex. 10 | Preparation of core particles (2) | 100/5 | same as above |

In each Example, 100 parts by weight of the above prepared toner particles and one part by weight of hydrophobic silica were mixed so as to cause the hydrophobic silica to attach to the surfaces of the toner particles.

Three parts by weight of the above toner particles was mixed with 100 parts by weight of silicone-coated ferrite carrier particles with a particle diameter of 70 μm, so that a two-component type developer was obtained.

The particle size (number mean diameter), the glass transition temperature, the softening point and the flow-initiating point of the vinyl resin having an alkali-reactive group employed in Examples 1 to 10 were measured in the following manners.

(1) Number mean diameter: measured by using "DLS-700" (Trademark), made by Otsuka Denshi Co., Ltd.

(2) Glass transition temperature: measured by a commercially available differential scanning calorimeter "DPS-6151" (Trademark), made by Rigaku Corporation, with the temperature increased by 10° C./min.

(3) Softening point and the flow-initiating point: measured by a flow tester of capillary type, commercially available from Shimadzu Corporation, in such a manner that 2.0 g of each resin was put into a die having a 0.5 mm-diameter opening and a cylinder pressure of 10 kg/cm$^2$ was applied to the resin, with the temperature being increased by 3° C./min.

The results are shown in Table 4.

TABLE 4

| Example No. | Number Mean Diameter (μm) | Tg (°C.) | Softening point (°C.) | Flow-Initiating Point (°C.) |
|---|---|---|---|---|
| 1, 2, 4 and 10 | 0.35 | 71 | 83 | 142 |
| 3 | 0.36 | 63 | 75 | 133 |
| 5 | 0.34 | 71 | 84 | 143 |
| 6 | 0.33 | 71 | 82 | 141 |
| 7 | 0.34 | 47 | 59 | 120 |
| 8 | 0.34 | 98 | 135 | 200 |
| 9 | 0.35 | 73 | 78 | 135 |

Comparative Example 1

100 parts by weight of the core particles prepared in [Preparation of core particles (1)] was added to 0.2% methanol solution containing 75 parts by weight of the fluorine-containing quaternary ammonium salt No. 1. While stirring the mixture, the methanol was allowed to evaporate. The resulting mixture was dried at 40° C. under reduced pressure, so that a comparative toner was obtained.

Using the thus obtained comparative toner, an image formation test was carried out. As a result, the toner deposition on the background took place after 10,000 copies were made.

Comparative Example 2

20 parts by weight of the fluorine-containing quaternary ammonium salt No. 1 was added to a methanol dispersion of 100 parts by weight of hydrophobic silica "Aerosil R972" (Trademark), made by Nippon Aerosil Co., Ltd., and dissolved uniformly therein. The above prepared mixture was dried, so that silica particles were obtained in such a fashion that finely-divided particles of the fluorine-containing quaternary ammonium salt were attached to the surface of each silica particle.

100 parts by weight of the core particles prepared in [Preparation of core particles (1)] and 0.9 parts by weight of the above prepared silica particles were uniformly mixed by using "O.M. dizer" (Trademark), made by Nara Machinery Co., Ltd. The thus obtained mixture was rotated at 10000 rpm for 5 minutes in a commercially available apparatus "Hybridization System NHS-O type" (Trademark), made by Nara Machinery Co., Ltd., for the purpose of applying mechanical energy to the mixture to firmly film the core particles with the silica particles. Thus, comparative toner was obtained.

Using the thus obtained comparative toner, an image formation test was carried out. As a result, the toner deposition on the background took place after 30,000 copies were made.

Using the above toners of the present invention prepared in Examples 1 to 10 and the comparative toners prepared in Comparative Examples 1 and 2, the following items were evaluated. The results are shown in Table 5.

(1) Charge quantity

Each toner was thoroughly mixed with silicone-coated ferrite carrier and the charge quantity of toner was measured by the blow-off method.

Charge quantity at a low humidity: measured after the developer was allowed to stand in an atmosphere of 15° C. and 10% RH for two hours.

Charge quantity at a middle humidity: measured after the developer was allowed to stand in an atmosphere of 20° C. and 50% RH for two hours.

Charge quantity at a high humidity: measured after the developer was allowed to stand in an atmosphere of 30° C. and 90% RH for two hours.

(2) Durability of toner

The charge quantity of the toner was measured by the blow-off method after 100,000 copies were made by using a commercially available plain paper copier "Imagio 420" (Trademark), made by Ricoh Company, Ltd., equipped with each of the above prepared developers.

(3) Sharpness of toner images

An initial dot-image developed by "Imagio 320" (Trademark), made by Ricoh Company, Ltd., was observed by a light microscope and evaluated with reference to a limit sample in accordance with the following scale:

5: Toner particles were only attached to dot portions, thereby making the outline of each dot remarkably sharp.

4: Most of toner particles were attached to the dot portions, but the outline of each dot was slightly obscure.

3: Lots of toner particles were attached to the dot portions, but the outline of each dot was obscure.

2: Toner particles were considerably scattered, but it was possible to recognize the existence of dots.

1: Toner particles were considerably scattered and it was impossible to recognize the existence of dots.

(4) Heat-resistant preservability of toner 10 g of each toner particles was placed in a screw bottle and a tap was turned on. After the toner was allowed to stand at 50° C. for 24 hours, the penetration of the toner was measured by a penetrometer.

(5) Image fixing performance

Using each developer, a toner image was fixed by an image-fixing unit of a commercially available "Imagio 420" (Trademark), made by Ricoh Company, Ltd., under the same image fixing conditions. The image fixing performance was evaluated by rubbing the fixed toner image. The peeling of the fixed toner image was assessed with reference to a limit sample in accordance with the following scale:

5: There was no peeling on the fixed toner image.

4: The toner image was peeled off in the form of a dot by rubbing.

3: The toner image was peeled off in the form of a broken line by rubbing.

2: The toner image was peeled off in the form of a narrow line by rubbing.

1: The toner image was peeled off in the form of a wide line by rubbing.

TABLE 5

| | Charge Quantity of Toner (μC/g) | | | Durability of Toner | Sharpness | Heat-resistant Preserv- | Image |
|---|---|---|---|---|---|---|---|
| | 15° C. 10% RH | 20° C. 50% RH | 30° C. 90% RH | Charge qt.(μC/g) | of Toner Image | ability (mm) | Fixing Performance |
| Ex.1 | −29.5 | −30.7 | −32.0 | −29.9 | 5 | 10 | 4 |
| 2 | −29.2 | −30.5 | −31.8 | −29.5 | 5 | 11 | 4 |
| 3 | −31.0 | −28.3 | −21.2 | −24.5 | 5 | 7 | 4 |
| 4 | −29.2 | −30.5 | −31.9 | −29.6 | 5 | 10 | 4 |
| 5 | −34.0 | −35.6 | −37.6 | −34.2 | 5 | 11 | 4 |
| 6 | −28.4 | −30.8 | −31.4 | −26.7 | 5 | 11 | 4 |
| 7 | −28.1 | −29.5 | −30.5 | −25.8 | 5 | 11 | 4 |
| 8 | −28.9 | −30.2 | −32.0 | −29.2 | 5 | 2 | 5 |
| 9 | −29.3 | −30.5 | −31.7 | −29.7 | 5 | 18 | 2 |
| 10 | −28.9 | −30.2 | −31.5 | −29.0 | 3 | 9 | 4 |
| Comp. Ex. 1 | −29.3 | −30.5 | −32.0 | −10.5 | 5 | 12 | 4 |
| Comp. Ex. 2 | −28.2 | −30.8 | −32.9 | −10.8 | 5 | 13 | 2 |

As previously explained, in the toner of the present invention, the fluorine-containing quaternary ammonium salt capable of controlling the chargeability of toner is allowed to react with finely-divided particles of a thermoplastic resin to obtain the surface-modified resin particles, and the core particle prepared by dying a resin particle with a dye is firmly and uniformly filmed with the above prepared surface-modified finely-divided particles. Therefore, the following advantages are imparted to the obtained toner.

(1) The core particles classified in a narrow particle size distribution are uniformly filmed with the charge controlling agent, which makes it possible to impart uniform charging characteristics to the toner particles. As a result, high quality toner images can be obtained.

(2) The material capable of controlling the chargeability of toner is bonded to the finely-divided resin particles and such a mixture is fixed to the surface of the core particle with the application of mechanical energy thereto. Therefore, the charge controlling material does not easily release from the surface of the core particle when the obtained toner particles are stirred, thereby improving the durability of the toner.

(3) Generally, the charge controlling material has a high melting point. In the toner of the present invention, a small amount of the charge controlling material in the form of molecule exists on the surface of the core particle, so that an impediment to the image fixing performance by the charge controlling material can be minimized. Toner images with excellent image fixing performance can be obtained.

(4) The charging characteristics of toner can be controlled only on the surface of the toner particle, so that the core particle is not affected by the charging. Therefore, a coloring agent can be freely selected and an excellent color toner can be obtained.

(5) It is possible to fix a relatively expensive charge controlling material only to the surface of the toner particle. The charge controlling can be accomplished by a small amount of the charge controlling material, and the toner can be prepared at a low cost.

What is claimed is:

1. A toner prepared by the process comprising the steps of allowing finely-divided particles of a vinyl resin having an alkali-reactive group to react with a fluorine-containing quaternary ammonium salt to obtain surface-modified finely-divided particles; mixing said surface-modified finely-divided particles and core particles comprising a resin and a coloring agent; and filming said core particles with said finely-divided particles of said surface-modified vinyl resin with application of mechanical energy thereto.

2. The toner as claimed in claim 1, wherein said surface-modified finely-divided particles contains no water-soluble component.

3. The toner as claimed in claim 1, wherein said core particles are prepared by dying said resin with said coloring agent.

4. The toner as claimed in claim 1, wherein the ratio of the volume mean diameter to the number mean diameter of said core particles is 1.3 or less.

5. The toner as claimed in claim 1, wherein said vinyl resin having an alkali-reactive group has a glass transition temperature of 50° C. or more.

6. The toner as claimed in claim 1, wherein said vinyl resin having an alkali-reactive group has a softening point of 60° to 130° C.

7. The toner as claimed in claim 1, wherein the number mean diameter of said vinyl resin having an alkali-reactive group is 1/10 or less that of said core particles.

8. The toner as claimed in claim 1, wherein said fluorine-containing quaternary ammonium salt is selected from the group consisting of:

$R_fN^+(R^1)_3X^-$,

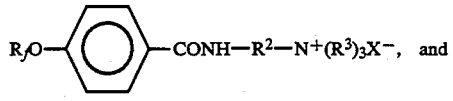

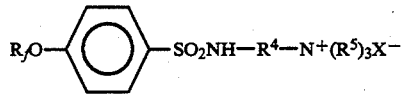

wherein $R_f$ represents a fluorine-containing group having 6 to 9 carbon atoms; $R^1$, $R^2$, $R^3$, $R^4$ and $R^5$ each represent a lower alkyl group having 1 to 4 carbon atoms, and $R^2$ and $R^3$, or $R^4$ and $R^5$ may be the same or different; and X represents a halogen.

9. The toner as claimed in claim 1, wherein the mixing ratio by weight of said finely-divided particles of said vinyl resin having an alkali-reactive group to said fluorine-containing quaternary ammonium salt is (100:0.5) to (100:5).

10. The toner as claimed in claim 1, wherein the mixing ratio by parts by weight of said surface-modified finely-divided particles to said core particles is (1:100) to (20:100).

11. A process of preparing a toner comprising the steps of allowing finely-divided particles of a vinyl resin having an alkali-reactive group to react with a fluorine-containing quaternary ammonium salt to obtain surface-modified finely-divided particles; mixing said surface-modified finely-divided particles and core particles comprising a resin and a coloring agent; and filming said core particles with said finely-divided particles of said surface-modified vinyl resin with application of mechanical energy thereto.

* * * * *